US005926887A

United States Patent [19]

Thompson et al.

[11] Patent Number: 5,926,887

[45] Date of Patent: Jul. 27, 1999

[54] MODE SHIFTER FOR A WASHING MACHINE

[75] Inventors: Robert Alan Thompson, Quaker Street; Walter Whipple, III, Amsterdam, both of N.Y.; Daniel Joseph Flores, Louisville, Ky.

[73] Assignee: General Electric Co., Schenectady, N.Y.

[21] Appl. No.: 08/939,070

[22] Filed: Sep. 29, 1997

[51] Int. Cl.[6] ..... D06F 37/40

[52] U.S. Cl. ..... 8/159; 68/23.7; 192/12 BA

[58] Field of Search ..... 68/23.7; 192/12 BA; 8/159

[56] References Cited

U.S. PATENT DOCUMENTS

| | | | |
|---|---|---|---|
| 2,656,702 | 10/1953 | Chapin . | |
| 2,751,773 | 6/1956 | Woodson | 68/23.7 |
| 2,758,685 | 8/1956 | Sisson | 68/23.6 X |
| 3,090,472 | 5/1963 | Morrison | 68/23.7 X |
| 3,306,082 | 2/1967 | Hasegawa et al. | 68/12.19 X |
| 3,744,325 | 7/1973 | Brucken | 68/23.7 X |
| 3,783,652 | 1/1974 | Archbold | 68/23.7 |
| 3,907,082 | 9/1975 | Shikamori et al. | 192/12 BA |
| 4,165,624 | 8/1979 | Ruble | 68/23.7 |
| 5,520,029 | 5/1996 | Savkar . | |

*Primary Examiner*—Philip R. Coe
*Attorney, Agent, or Firm*—Tyler Maddry; Noreen C. Johnson

[57] ABSTRACT

A washing machine with an improved mode shifter comprises a basket for holding an article to be washed, a basket collar coupled to the basket, an agitator disposed within the basket, an agitator collar coupled to the agitator, a brake for reducing a rotational velocity of the basket, a brake collar coupled to the brake, a first spring disposed around the basket collar and the agitator collar, and a second spring disposed around the first spring, the basket collar, and the brake collar. The mode shifter provides a mechanically simple, inexpensive, and reliable mechanism for shifting from the agitation mode to the spin mode to the brake mode in a wash cycle.

37 Claims, 9 Drawing Sheets

MODE SHIFTER FOR A WASHING MACHINE

BACKGROUND

1. Field of the Invention

The present invention relates generally to washing machines, and more particularly to a mode shifter for a washing machine which enables the execution of an agitation mode, a spin mode, and a brake mode.

2. Description of the Related Art

A typical washing machine for washing clothing goes through a wash cycle which includes a number of modes of operation. Generally, the wash cycle includes an agitation mode in which the clothes are agitated in detergent, a rinse mode, and a spin mode in which water is removed from the clothes.

Washing machines generally include two components which come into contact with the clothes, the basket and the agitator. The basket is typically a cylindrical container which holds the clothes to be washed and which may have holes in its walls to drain the washing liquid (e.g., detergent and water) during the spin cycle. The agitator is located within the basket and serves to agitate the clothes and the wash liquid in the basket. The combination of the mechanical action of the agitator and the chemical action of the wash liquid washes the clothes. The basket and agitator are generally located within a second container conventionally known as the tub. The tub keeps the wash liquid within the basket during the wash cycle.

To power the agitator and the basket, a conventional induction motor may be used. The basket and agitator each have drive shafts, which may be concentric, for independently driving their respective motions. The agitator drive shaft may be connected to the motor through a transmission. The transmission reduces motor speed and converts the rotary motion of the motor into an oscillatory output for the agitator drive shaft. The basket drive shaft is typically connected to the motor through the outer case of the transmission.

During the agitation mode, the basket drive shaft is held stationary while the agitator drive shaft is oscillated. The basket drive shaft is typically locked to the washer frame through a brake and carries the reaction forces from the transmission during agitation into the frame. During the spin mode, power is applied to the basket drive shaft, and both the agitator and basket drive shafts are rotated together. During spin mode, the brake is released so the basket and agitator can be spun up to a high speed to expel wash water from the clothes through holes in the basket.

To switch from agitation mode to spin mode, a mode shifter is used. The mode shifter changes the point of power application from the agitator to the basket. An automatic brake is also typically provided to quickly stop the basket to avoid an accident if the washer lid is raised during the spin mode. There are many known ways of achieving the mode shift and brake functions. However, a common problem with many known systems is the level of mechanical complexity of each, which adversely effects cost and reliability. It would be desirable, therefore, to have a washing machine comprising a mode shifter which is mechanically simple, inexpensive, and reliable, to overcome problems encountered in known systems.

SUMMARY

An exemplary washing machine comprises a basket for holding an article to be washed; a basket collar coupled to the basket; an agitator disposed within the basket; an agitator collar coupled to the agitator; a brake for reducing a rotational velocity of the basket; a brake collar coupled to the brake; a first spring disposed around the basket collar and the agitator collar; and a second spring disposed around the first spring, the basket collar, and the brake collar.

The mode shifter, according to exemplary embodiments of the invention, changes modes from agitation to spin and from spin to safety braking in a simple and reliable way. The brake significantly reduces noise.

BRIEF DESCRIPTION OF THE DRAWINGS

Other features and advantages of the invention will be more readily understood upon reading the following detailed description in conjunction with the drawings, in which.

DETAILED DESCRIPTION OF THE PREFERRED EMBODIMENTS

Figure 1:
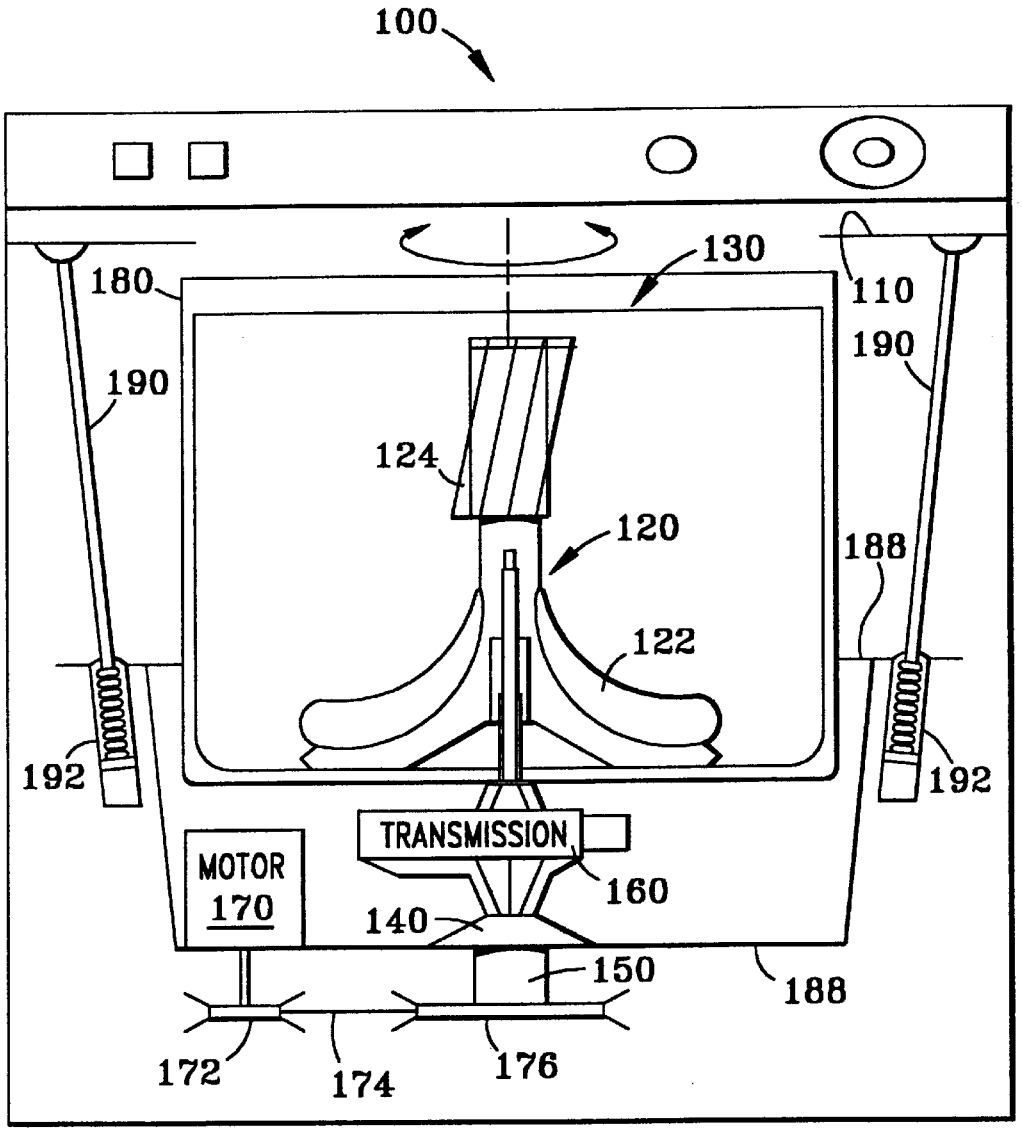
FIG. 1 is a schematic drawing of a washing machine according to a first embodiment of the invention.

Referring to FIG. 1, a washing machine 100, according to an exemplary embodiment of the invention, includes a frame 110 for supporting the components of the washing machine 100, a basket 130 for holding articles such as clothes to be washed, and an agitator 120 for agitating the clothes in the basket 130. The agitator 120 may be molded out of a plastic such as polypropylene and may include a plurality of vanes 122. The vanes 122, which are typically flexible, mechanically agitate the clothes back and forth within the basket. In addition, the washing machine 100 may include an auger 124 at the top of the agitator 120. The auger 124 further enhances the movement of the clothes within the basket 130. The basket 130 and agitator 120 sit within a tub 180 which retains the wash water during the wash cycle.

To power the washing machine 100 a motor 170, such as an AC induction motor, is provided. The motor 170 is coupled to the basket 130 and the agitator 120 through a motor pulley 172, a belt 174, a drive pulley 176, a mode shifter 150, a transmission 160, and basket and agitator drive shafts. Braking of the basket 130 and agitator 120 is achieved with a brake 140. The mode shifter 150 enables the motor 170 and brake 140 to execute an agitation mode, a spin mode, and a brake mode.

The tub 180, basket 130, agitator 120, transmission 160, brake 140, mode shifter 150, and motor 170 are typically mounted together on a platform 188. The platform 188 may be supported from the frame 110 by a suspension system comprising a plurality of rods 190 and springs 192. This suspension system, an example of which is described in commonly-owned U.S. Pat. No. 5,520,029, entitled "Coil Spring and Snubber Suspension System for a Washer", which is hereby incorporated by reference, provides the advantage of low transmissibility of the out of balance forces and vibrations to the frame 110, which improves the stability of the washing machine 100.

Figure 2:
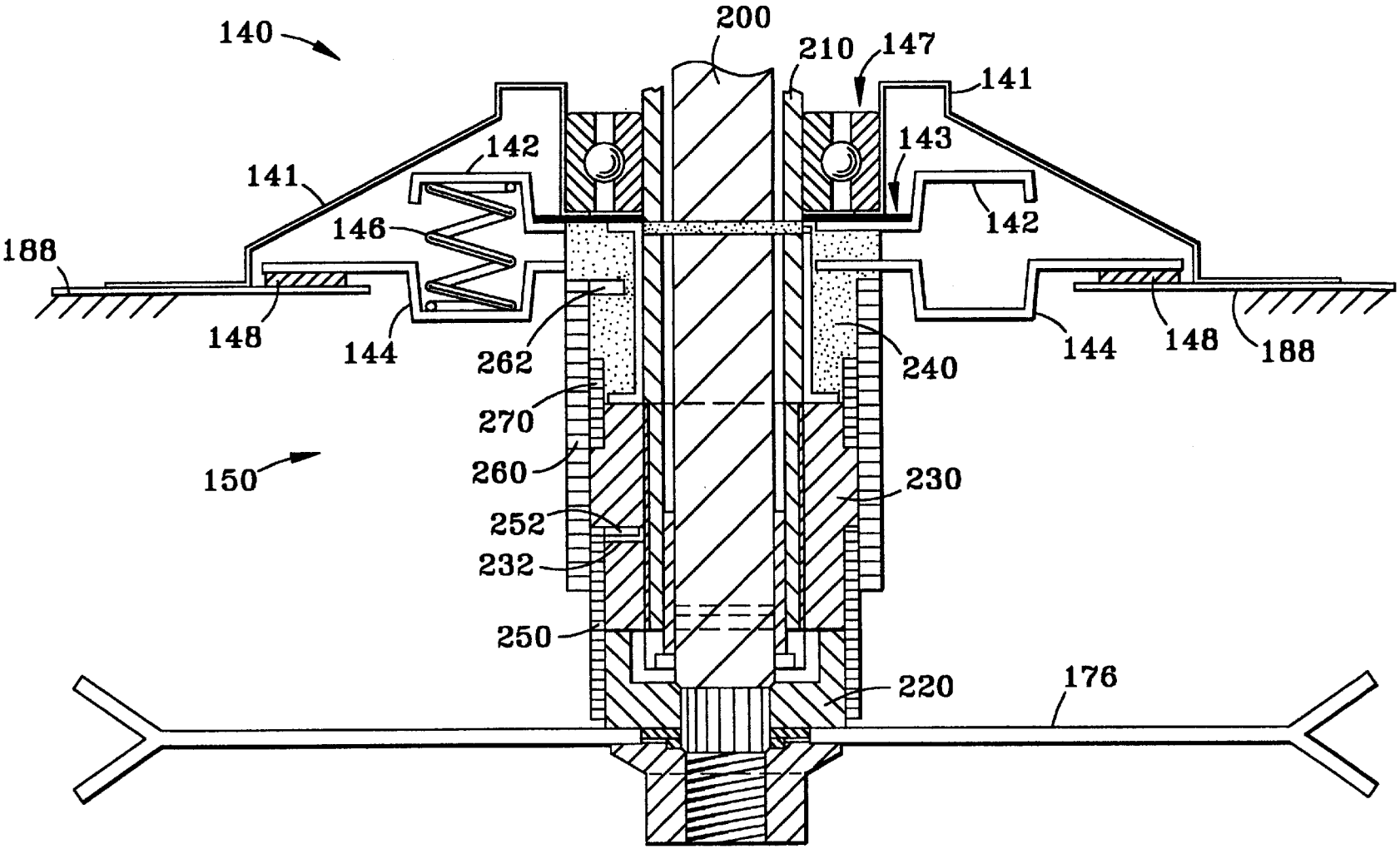
FIG. 2 is a drawing of the mode shifter from the washing machine of FIG. 1.

Referring to FIGS. 1 and 2, a mode shifter 150, according to an exemplary embodiment of the invention, is shown. The mode shifter 150 includes three collars and two shafts which are used to control the motion of the agitator 120 and the basket 130. The agitator shaft 200 is concentric with and inside of the basket shaft 210. The agitator shaft 200 is fixed at one end to the transmission 160 and at the other end to the agitator collar 220. The agitator shaft 200 thus couples the agitator collar 220 to the agitator 120 through the transmission 160 such that the agitator collar 220 can drive the agitator 120. The basket shaft 210 is fixed at one end to the outer case of the transmission 160 and at the other end to the basket collar 230. The basket shaft 210 couples the basket collar 230 to the basket 130 through the outer case of the transmission 160 such that the basket collar 230 can drive the basket 130. Above the basket collar 230 is the third collar, the brake collar 240. The brake collar 240 is fixed to the brake 140, as will be described further below.

Power from the motor 170 is input to the mode shifter 150 through the drive pulley 176. The drive pulley 176 is fixed to the agitator collar 220 and the agitator shaft 200. Rotation of the motor 170 causes rotation of the drive pulley 176, the agitator collar 220, and the agitator shaft 200.

The mode shifter 150, according to an exemplary embodiment of the invention, includes three springs which are disposed around the three collars 220, 230, 240. A first, basket engagement spring 250 is disposed around both the agitator collar 220 and the basket collar 230. A second, brake engagement spring 260 is disposed around the brake collar 240, the basket collar 230, and the basket engagement spring 250. A third, basket immobilizer spring 270 is disposed in a recess on a peripheral portion of the brake collar 240 and the basket collar 230.

The three springs 250, 260, and 270 perform the function of clamping the collars together during different modes of the wash cycle, and may be referred to as "clutch" springs. Clamping is accomplished by winding the springs more tightly around a pair of collars such that the friction between the spring and the collars is increased to the point at which the spring clamps the collars together. When two collars are clamped together, torque may be transmitted from one collar to the other collar. To provide increased friction, the cross section of the coil wire which forms the spring is typically rectangular. The rectangular cross section provides a flat inner and outer cylindrical surface which contacts the collars or other springs over a large surface area. The large surface area provides increased friction for clamping as the spring is tightened, for example around two collars.

In the agitation mode of the wash cycle, the motor 170 rotates the agitator collar 220 in a first direction which tends to unwind the basket engagement spring 250 through friction. For example, when viewed from above, the agitator collar 220 is rotated clockwise in agitation mode, while the basket engagement spring 250 is wound downward in a counter-clockwise direction ("counterclockwise down"). These directions are of course given as an example, and can be reversed if desired.

When the motor 170 is rotated in the first direction during agitation mode, the agitator collar 220 slips within the basket engagement spring 250, because the agitator collar 220 tends to unwind the basket engagement spring 250. The basket engagement spring 250 is thus not clamped around the agitator collar 220 and the basket collar 230, so that these two collars (and hence the basket 130 and agitator 120) are free to move independently in agitation mode. The transmission 160 above the mode shifter 150 converts the rotary motion of the motor 170 and agitator collar 220 into an oscillatory motion of the agitator 120. The basket 130 and basket collar 230 are typically immobilized in agitation mode, as will be discussed below.

The transition from agitation mode to spin mode involves locking the basket collar 230 to the agitator collar 220 with the basket engagement spring 250 so that the basket 130 and agitator 120 rotate together. This is accomplished by reversing the rotation direction of the motor 170 to a second rotation direction, ("spin direction", e.g., counterclockwise viewed from above) which is opposite the first rotation direction used for agitation mode. The friction between the agitator collar 220 and the basket engagement spring 250 causes the basket engagement spring 250 to wind more tightly around the agitator collar 220, because the basket engagement spring 250 has an interference fit with a portion of the agitator collar 220 (see "d" in FIG. 3).

Figure 3:
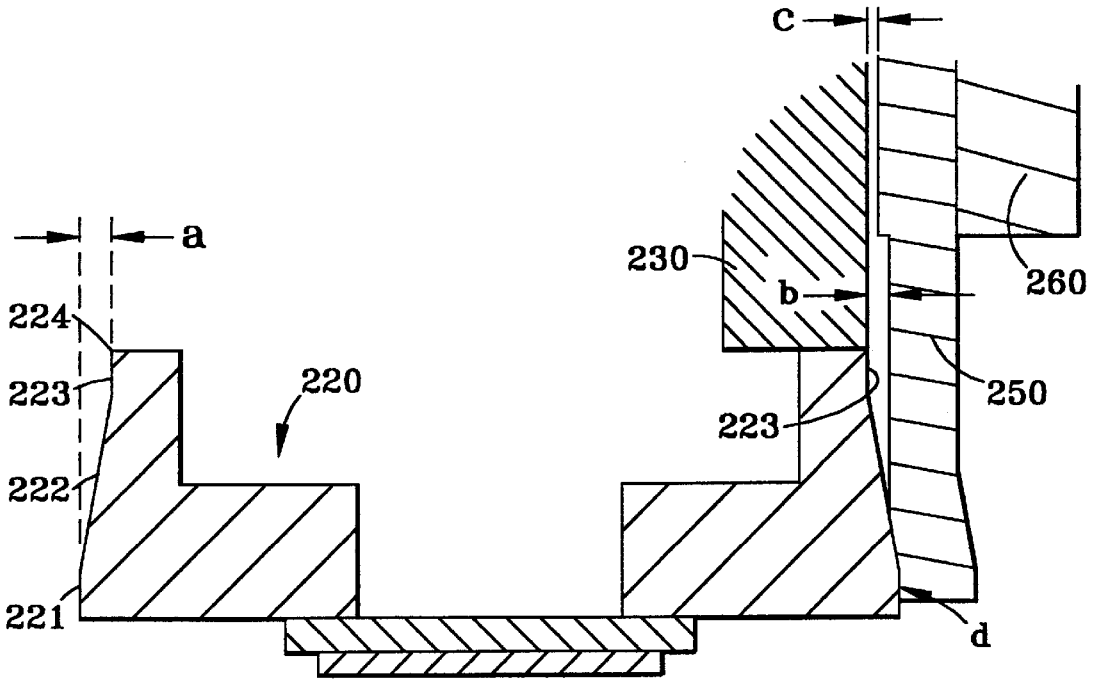
FIG. 3 is a drawing of the agitator collar of the mode shifter of FIG. 2.
Figure 8:
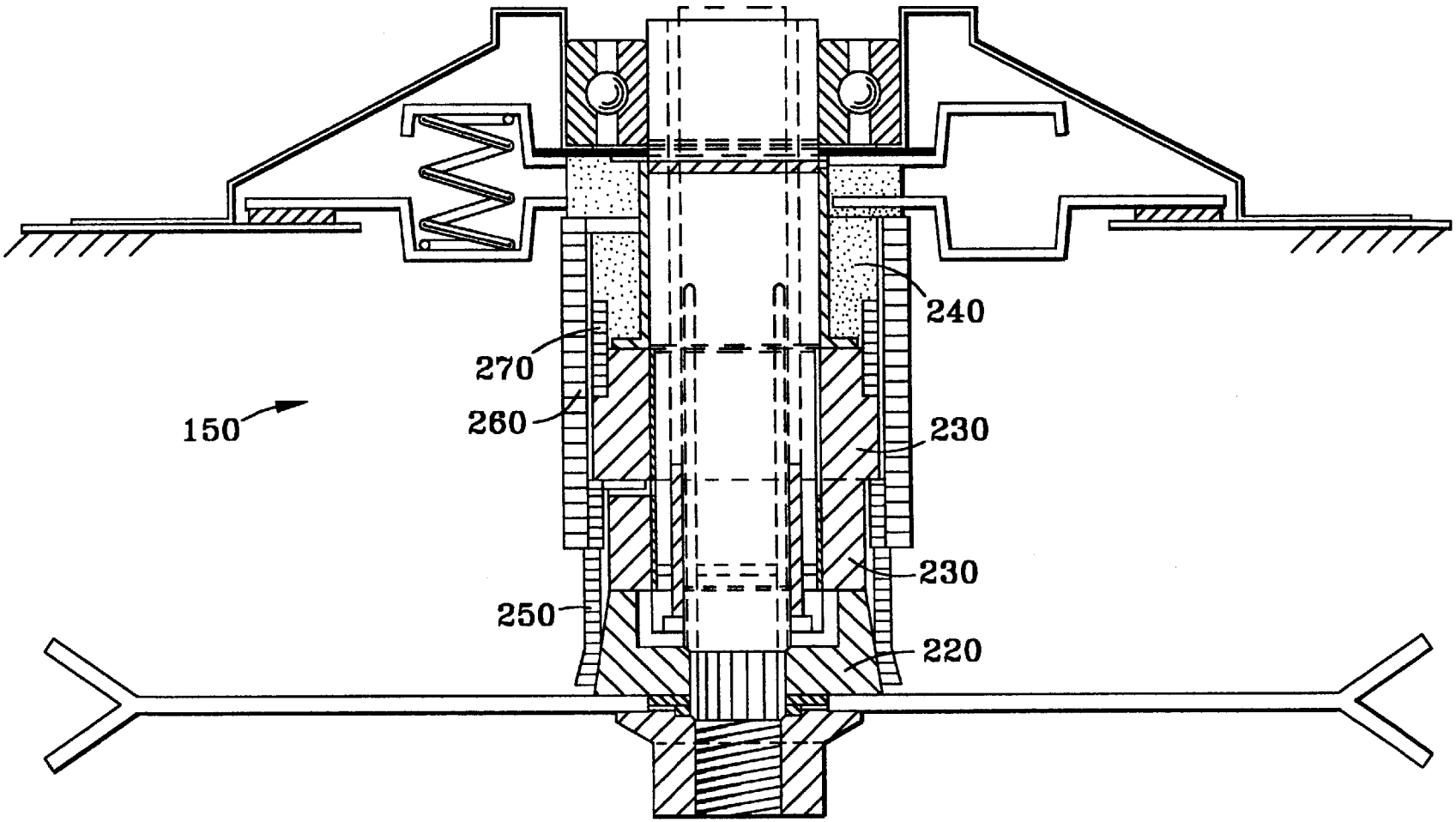
FIG. 8 is an expanded view of the mode shifter of FIG. 2.

FIGS. 3 and 8 are drawings of the mode shifter 150 at rest, in which the clearances and interferences between the springs 250, 260, 270 and collars 220, 230, 240 are exaggerated for clarity. As shown in FIG. 3, the agitator collar 220 includes a first cylindrical portion 221 which has an interference fit (at "d") with the surrounding basket engagement spring 250 when the mode shifter is at rest. According to an exemplary embodiment, the outer diameter of the first cylindrical portion 221 of the agitator collar 220 is about 0.01 inch larger than the inner diameter of the basket engagement spring 250 to produce the interference fit when the mode shifter is at rest.

The top of the basket engagement spring 250 includes a tang 252, as shown in FIG. 2, which resides in a recess 232 of the basket collar 230. The tang 252 rotationally fixes the basket engagement spring 250 to the basket collar 230, which allows the friction at the bottom of the basket engagement spring 250 to wind the spring 250 more tightly around the agitator collar 220 and basket collar 230. This winding has a positive feedback effect, because it increases the friction exponentially between the agitator collar 220 and the basket engagement spring 250, which causes the spring to wind more tightly by the rotation of the agitator collar 220, etc.

The basket engagement spring 250 quickly winds around the agitator collar 220 and the basket collar 230, locking the two collars together, which locking is maintained as long as a small torque in the second rotation direction (spin direction e.g., counterclockwise viewed from above) is applied to the agitator collar 220. The small torque may be, for example, that torque necessary to maintain the basket engagement spring 250 in a wound down state. Because the basket collar 230 is locked to the agitator collar 220, the basket 130 and the agitator 120 rotate together in spin mode.

At rest, the brake engagement spring 260 has an interference fit with the basket engagement spring 250, i.e., the outer diameter of the basket engagement spring 250 is about 0.01 inch larger than the inner diameter of the brake engagement spring 260, as shown in FIG. 8. However, when the basket engagement spring 250 is wound tightly around the agitator collar 220 and basket collar 230, its outer diameter decreases so that it does not have an interference fit with the inside of the brake engagement spring 260. The agitator collar 220 and basket collar 230 are thus free to rotate in spin mode without engaging the brake engagement spring 260 and the brake 140.

The agitator collar 220 has a tapered outer surface, as shown in FIG. 3. In FIG. 3, the agitator collar 220 includes the first cylindrical portion 221, a tapered portion 222, and a second cylindrical portion 223. The taper of the tapered portion 222 is exaggerated in FIG. 3 for clarity. The taper, as defined by the reference letter "a", is typically about 0.030 inch. The taper is provided so that the bottom end of the agitator collar 220 has an interference fit of about 0.010 inch with the basket engagement spring 250 (see "d"), while the top end of the agitator collar 220 has the same outer diameter as the basket collar 230 where they meet. The matched diameters of the agitator collar 220 and basket collar 230 prevent the basket engagement spring 250 from damaging the collars at their interface, as could occur if there were a substantial discontinuous change in outer diameter (e.g., greater than 0.005 inch).

As shown in FIG. 3, the basket collar 230 has an outer diameter which allows a clearance with the basket engagement spring 250 at rest and in agitation mode. Typically, the outer diameter at the top 224 of the agitator collar is about 0.02 inch less than the inner diameter of the basket engagement spring 250, as indicated by reference letter "b". At reference letter "c", the clearance is reduced to about 0.010 inch, because the brake engagement spring 260 forces the basket engagement spring 250 inward by about 0.010 inch. Thus, at "b" and "c", the basket engagement spring 250 has a clearance with the basket collar, while at "d", the basket engagement spring has an interference fit with the agitator collar 220, when the mode shifter is at rest or in agitation mode. The clearance between the basket engagement spring 250 and the basket collar 230 allows the agitator collar 220 to rotate during agitation mode without engaging the basket collar 230 and basket 130. Because the rotation of the agitator collar 220 in agitation mode causes the basket engagement spring 250 to unwind and slip on the agitator collar 220, the clearance between the basket engagement spring 250 and the basket collar 230 is maintained during agitation mode.

In spin mode, as long as the agitator collar 220 is supplied with a small spin torque (e.g., counterclockwise from above), the basket engagement spring 250 remains locked around the agitator collar 220 and basket collar 230. In spin mode, the outer diameter of the basket engagement spring 250 is reduced so that it does not engage with the surrounding brake engagement spring 260 to activate the brake 140. As shown in FIG. 8, the brake engagement spring 260 has a clearance, typically about 0.01 inch at rest, with the basket collar 230, the brake collar 240, and the basket immobilizer spring 270. This clearance allows the agitator collar 220, basket collar 230 and basket engagement spring 250 to spin together during spin mode without engaging the brake engagement spring 260 and brake collar 240.

If during the spin mode, the washing machine lid is opened, the motor power is typically interrupted. This may be accomplished, for example, with a conventional switch activated by the lid of the washing machine which senses when the lid is opened and responds by inactivating the motor 170. If the motor power is interrupted and the spin torque applied to the agitator collar 220 is removed, the basket engagement spring 250 will unwind, releasing the basket collar 230 and the agitator collar 220. At the same time, the outer diameter of the basket engagement spring 250 increases, so that it comes into contact with the inner surface of the brake engagement spring 260. The basket engagement spring 250 continues to spin because it is rotationally fixed with a tang 252 (FIG. 2) to the basket collar 230, which continues to spin from the rotational inertia of the basket 130. The rotational inertia of the basket 130 thus produces a torque which is applied by friction from the rotating expanded basket engagement spring 250 to the bottom of the brake engagement spring 260.

The friction that develops between the basket engagement spring 250 and the brake engagement spring 260 begins to wind the brake engagement spring 260 more tightly around the basket collar 230 and the brake collar 240. At rest, the brake engagement spring 260 has a clearance of about 0.01 inch with the basket collar 230. The brake engagement spring 260 is wound in the same direction (e.g., counterclockwise down) as the basket engagement spring 250. The top of the brake engagement spring 260 includes a tang 262 (FIG. 2) which resides in the brake collar 240 to rotationally fix the brake engagement spring 260 to the brake collar 240. The tang 262 holds the top of the brake engagement spring 260 stationary while the bottom of the brake engagement spring 260 is tightened by the expanded, rotating, basket engagement spring 250. The friction that develops between the basket engagement spring 250 and the brake engagement spring 260 winds the brake engagement spring 260 more tightly around the basket collar 230 and the brake collar 240, creating a positive feedback effect which locks the basket collar 230 and brake collar 240 together.

As shown in FIG. 2, the brake collar 240 is coupled to the brake 140. The brake 140, which is housed in a brake housing 141, comprises an upper disc 142 and a lower disc 144 which are coupled by a plurality (e.g. 3) of brake springs 146, one of which is shown in FIG. 2. The upper disc 142 is fixed to the brake collar 240 both rotationally, and axially along the rotation axis. The lower disc 144 is fixed to the brake collar 240 rotationally, but can move axially along the rotation axis. The brake springs 146 thus force the lower disc 144 downward so that it forcefully contacts the platform 188 through a brake pad 148. The brake is thus typically always engaged since the brake springs 146 force the lower disc 144 and brake pad 148 against the platform 188. A thrust washer 143 is provided to maintain a downward force on the upper disc 142. The thrust washer 143 sits below the brake housing 141 and a cylindrical bearing 147.

When the brake engagement spring 260 locks the basket collar 230 to the brake collar 240, the rotational inertia of the basket 130 causes the upper and lower discs 142, 144 to begin to spin. Energy is therefore dumped into the braking system from the rotating basket 130, and the basket 130 quickly stops.

If the motor power (spin torque) is restored to the agitator collar 220 before the basket stops, or at any other time, the friction from the agitator collar 220 causes the basket engagement spring 250 to tighten and withdraw inwardly from the brake engagement spring 260. The stiffness of the brake engagement spring 260 is preferably larger than the stiffness of the basket engagement spring 250. According to one embodiment, the brake engagement spring 260 has a cross section of 0.156 inch (radial direction "r")×0.085 inch (height "h"), and the basket engagement spring has a cross section of 0.096 inch (radial direction "r")×0.062 inch (height "h"). As stiffness is proportional to $(hr^3)/12$, the brake engagement spring 260 has a stiffness which is about 5.9 times the stiffness of the basket engagement spring 250. This allows the brake engagement spring 260 to resist being drawn in by the basket engagement spring 250, releasing the brake engagement spring 260 so that the springs 250, 260 can disengage. This releases the brake engagement spring 260 and with it the brake 140. The brake engagement spring

260 loosens and unwinds, releasing the lock between the brake collar 240 and the basket collar 230, so that the basket 130 is free to rotate in spin mode without engaging the brake 140.

At the same time, the torque on the agitator collar 220 in the spin direction causes the basket engagement spring 250 to tighten and lock around the agitator collar 220 and basket collar 230, thus restoring the spin mode configuration in which the agitator 120 and basket 130 are locked together.

According to an exemplary embodiment of the invention, the following clearances or interference fits between the various springs and collars, at rest, are used. The basket collar 230 has a clearance of about 0.01 inch ("c" in FIG. 3) or 0.02 inch ("b" in FIG. 3) with the basket engagement spring 250, a clearance of about 0.01 inch with the brake engagement spring 260, and an interference fit of about 0.01 inch with the basket immobilizer spring 270. The brake collar 240 has a clearance of about 0.01 inch with the brake engagement spring 260, and an interference fit of about 0.01 inch with the basket immobilizer spring 270. The brake engagement spring 260 has an interference fit of about 0.01 inch with the basket engagement spring 250 at rest, and a clearance of about 0.01 inch with the basket immobilizer spring 270. The basket engagement spring 250 has an interference fit of about 0.01 inch with the bottom of the agitator collar 220 and a clearance of about 0.02 inch with the top of the agitator collar 220.

The brake collar 240, according to another embodiment, can be tapered such that it has an interference fit of about 0.01 inch with the top of the brake engagement spring 260, and such that a clearance of about 0.01 inch exists inward of the brake engagement spring 260 at the bottom of the brake collar 240. This clearance may exist outward of the basket immobilizer spring 270 (FIG. 2) or outward of the brake collar 240 (FIG. 6) where no basket immobilizer spring is provided. The taper allows for an interference fit at the top of the brake engagement spring 260, which reduces the angle traversed by the basket before the brake engagement spring 260 locks together the brake collar 240 and basket collar 230.

In the agitation mode, torques applied to the agitator by the clothes in the basket can cause the basket 130 and transmission case to rotate or precess. This occurs because the transmission case experiences a reaction torque equal and opposite to the torque applied to the agitator 120 by the clothes and the wash liquid. The reaction torque applied to the transmission case rotates the transmission case and the basket 130, which is connected to the transmission case. To prevent the rotation of the basket 130, the basket immobilizer spring 270 may be provided which works in conjunction with the brake engagement spring 260 to rotationally fix the basket 130 in both directions during agitation mode. The basket immobilizer spring 270 operates as follows.

As discussed above, if spin mode is interrupted, the basket engagement spring 250, rotating in the spin direction (e.g., counterclockwise viewed from above), expands in diameter to contact the brake engagement spring 260, which tightens the brake engagement spring 260 through friction, locking the basket collar 230 to the brake collar 240. Similarly, if a torque is applied to the agitator by the clothes to impart a reaction torque to the transmission 160 and basket 130 in the direction of spin during agitation (where the basket engagement spring 250 is expanded in diameter), the basket 130 is locked to the brake 140 and immobilized. This occurs because the basket engagement spring 250 rotates in the direction of spin from the reaction torque, while the basket engagement spring 250 is expanded because it is in the agitation mode, resulting in a tightening of the brake engagement spring 260 around the basket collar 230 and brake collar 240.

If the reaction torques from the clothes and the wash liquid rotate the basket 130 in the direction opposite spin (e.g., clockwise viewed from above), the opposite action occurs, i.e., the basket 130 is unlocked from the brake 140. This occurs because the expanded basket engagement spring 250 winds inwardly away from the brake engagement spring 260, allowing the basket engagement spring 260 to unwind away from the brake collar 240. Thus, the brake is released, and the basket 130 is free to rotate opposite the spin direction during agitation mode.

To prevent the basket 130 from rotating opposite the spin direction in agitation mode, the basket immobilizer spring 270 is provided. The basket immobilizer spring 270 fits into an annular recess cut out of both the brake collar 240 and the basket collar 230. The basket immobilizer spring 270 has about a 0.01 inch interference fit with the annular recess in both the brake collar 240 and the basket collar 230, and is wound in a direction opposite to the winding direction of both the basket engagement spring 250 and the brake engagement spring 260 (e.g., clockwise down).

Because the basket immobilizer spring 270 is oppositely wound and has an interference fit, it locks together the basket collar 230 and the brake collar 240 through a positive feedback friction effect when clothes and wash liquid torque the agitator and create a reaction torque on the transmission 160 and basket 130 in the direction opposite from the spin direction. Thus, the basket immobilizer spring 270 and the brake engagement spring 260 together prevent the basket 130 from rotating in either direction due to the reaction torques in agitation mode.

The basket immobilizer spring 270 does not interfere with the spin mode or the braking mode, because the basket immobilizer spring 270 unlocks so that slippage can occur when the basket collar 230 rotates in the spin direction, freeing the basket collar 230 from the brake collar 240. During braking from spin, the brake engagement spring 260 squeezes down onto the basket immobilizer spring 270 which transmits the radially inward forces of the brake engagement spring 260 to the basket collar 230 and the brake collar 240, which contributes to braking.

Figure 4:
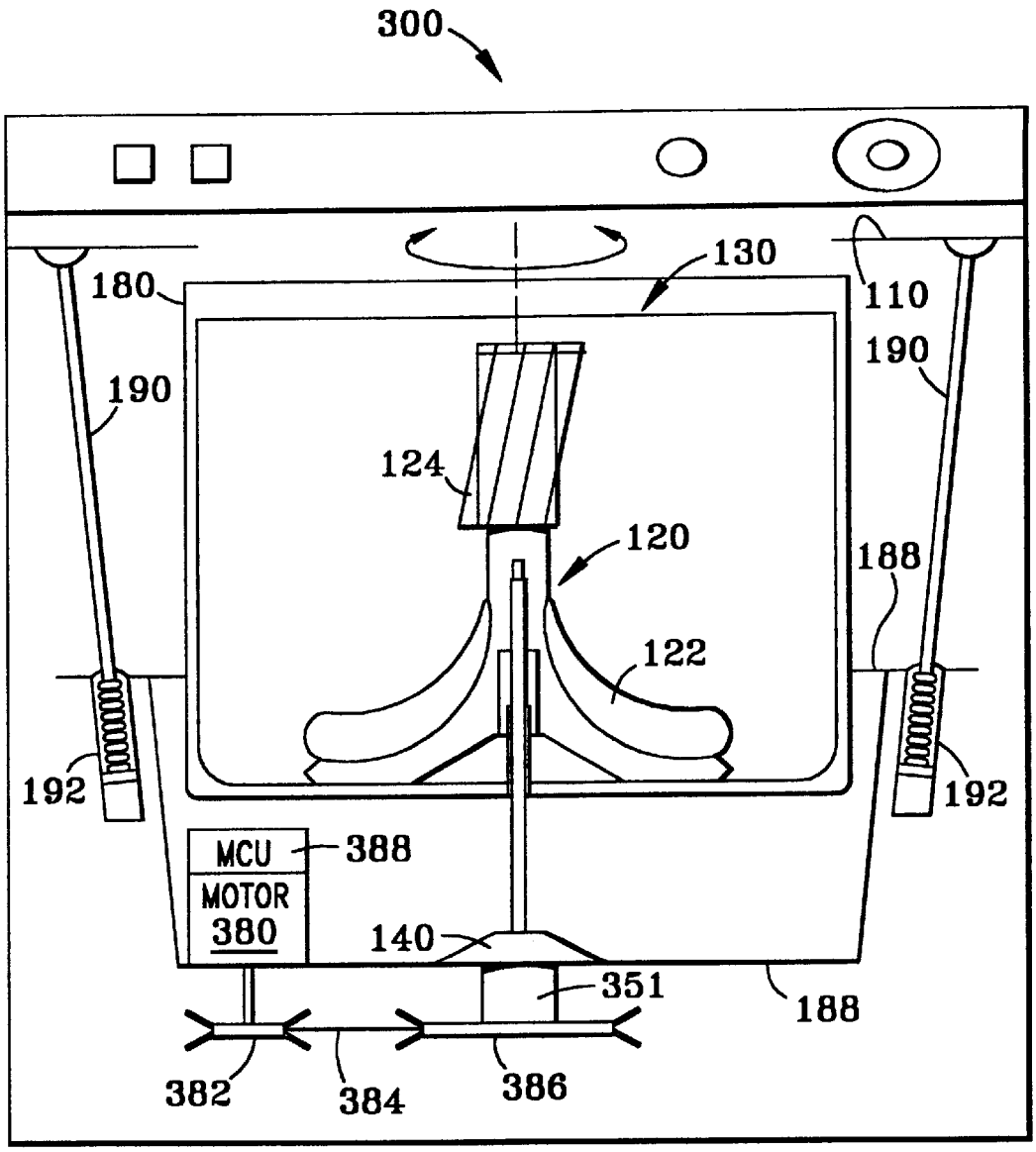
FIG. 4 is a drawing of a washing machine according to a second embodiment of the invention.

According to another embodiment of the invention illustrated in FIG. 4, the mode shifter can be adapted to operate in conjunction with a washing machine powered by a variable speed motor. The variable speed motor 380 shown in FIG. 4 is advantageous, because its rotational velocity and torque can be easily controlled, as compared, for example, with an AC induction motor. The washing machine 300 shown in FIG. 4 includes many of the same components as the washing machine 100 of FIG. 1. For brevity, the description of similar features, which are labeled with the same reference numerals, will not be repeated.

The variable speed motor 380 may comprise a commutator and brush, or an electronic commutator which switches the direction of current flow in the stator windings to torque the rotor in a desired direction. Examples of variable speed motors include brushless DC motors (e.g., electronically commutated motors and switched reluctance motors), universal motors, DC motors, and phase controlled induction motors.

Typically, the variable speed motor is a single-phase electronically commutated motor (ECM). The ECM includes a stator which comprises an electromagnet having a number of windings, and a rotor disposed within the stator which includes a number of permanent magnets. The electromagnet of the stator comprises at least one coil which, when energized, produces a magnetic field. The permanent magnets of the rotor create a back electromotive force in reaction to the stator magnetic field. The ECM also includes an electronic commutator which switches the direction of current flow in the stator windings so that the electromotive force generated in each winding torques the rotor in the desired direction. By controlling the voltage and frequency across the stator coil, the speed and torque of the rotor may be precisely controlled. One example of a suitable single phase ECM is the FRAME 39 motor manufactured by General Electric Motors and Industrial Systems.

Because the torque, speed and rotation direction of the variable speed motor 380 are easily controlled, the washing machine 300 can operate without a transmission, as in conventional washing machines, to change the direction of motion during the agitation mode. The motion of the agitator 120 and basket 130 in the various modes of the wash cycle is achieved with the motor control unit (MCU) 388. The MCU 388 typically includes a microprocessor which is programmed to control the currents and voltages input to the stator coil over time. For example, the MCU 388 may be programmed to periodically reverse the current input to the stator windings to effect an oscillatory motion which oscillates the agitator 120 in agitate mode. In spin mode, the frequency of power supplied to the stator coil may be increased to increase the rotational velocity of the basket 130 and agitator 120. The MCU 388 may also be programmed to effect regenerative braking, in which the stator coil current is controlled to apply a torque to the rotor in a direction opposite the rotational velocity of the rotor. The rotor can also be stopped by shunting the windings of the stator through a suitable load. Because a transmission is unnecessary, the concentric agitator shaft and basket shaft can be directly connected to the agitator 120 and basket 130, respectively. The washing machine 300 can also operate without a motor clutch, which typically accompanies an AC induction motor to allow for differences in rotation speed between the motor and the drive pulley.

Figure 5:
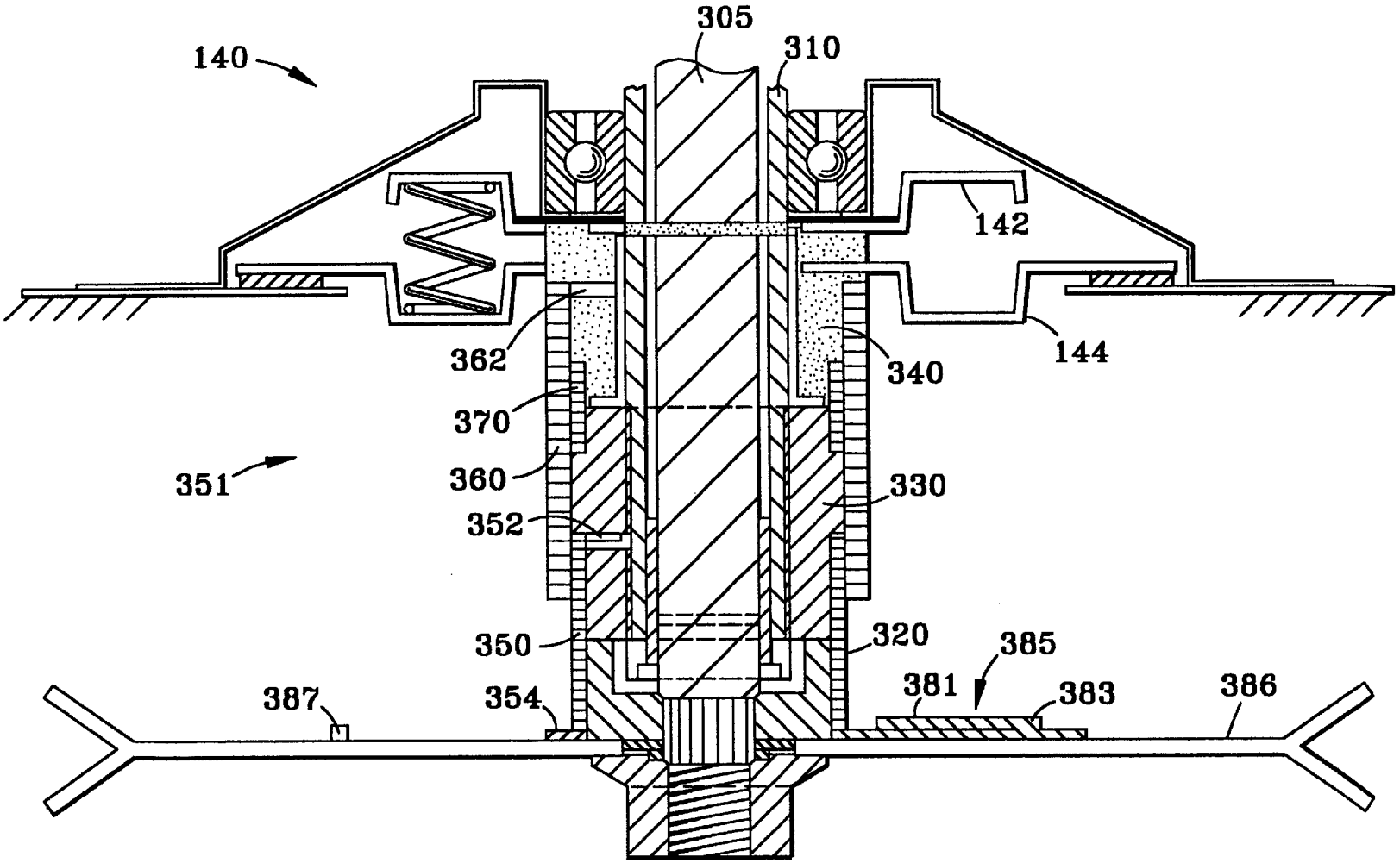
FIG. 5 is a drawing of the mode shifter shown in FIG. 4.

The mode shifter 351 of the washing machine 300 is shown in FIG. 5, according to an exemplary embodiment of the invention. The mode shifter 351 includes an agitator collar 320, basket collar 330, and brake collar 340, which are coupled to the agitator 120, basket 130, and brake assembly 140, respectively. The mode shifter 351 includes a basket engagement spring 350, a brake engagement spring 360, and a basket immobilizer spring 370. These elements generally operate as described above with respect to FIG. 2, with certain exceptions which will be described below.

The agitator shaft 305 is coupled directly to the agitator 120, without a transmission. The basket shaft 310 is coupled directly to the basket 130. The motor power is coupled from the variable speed motor 380 to the agitator collar 320 through a motor pulley 382, a belt 384, and a drive pulley 386.

Figure 9:
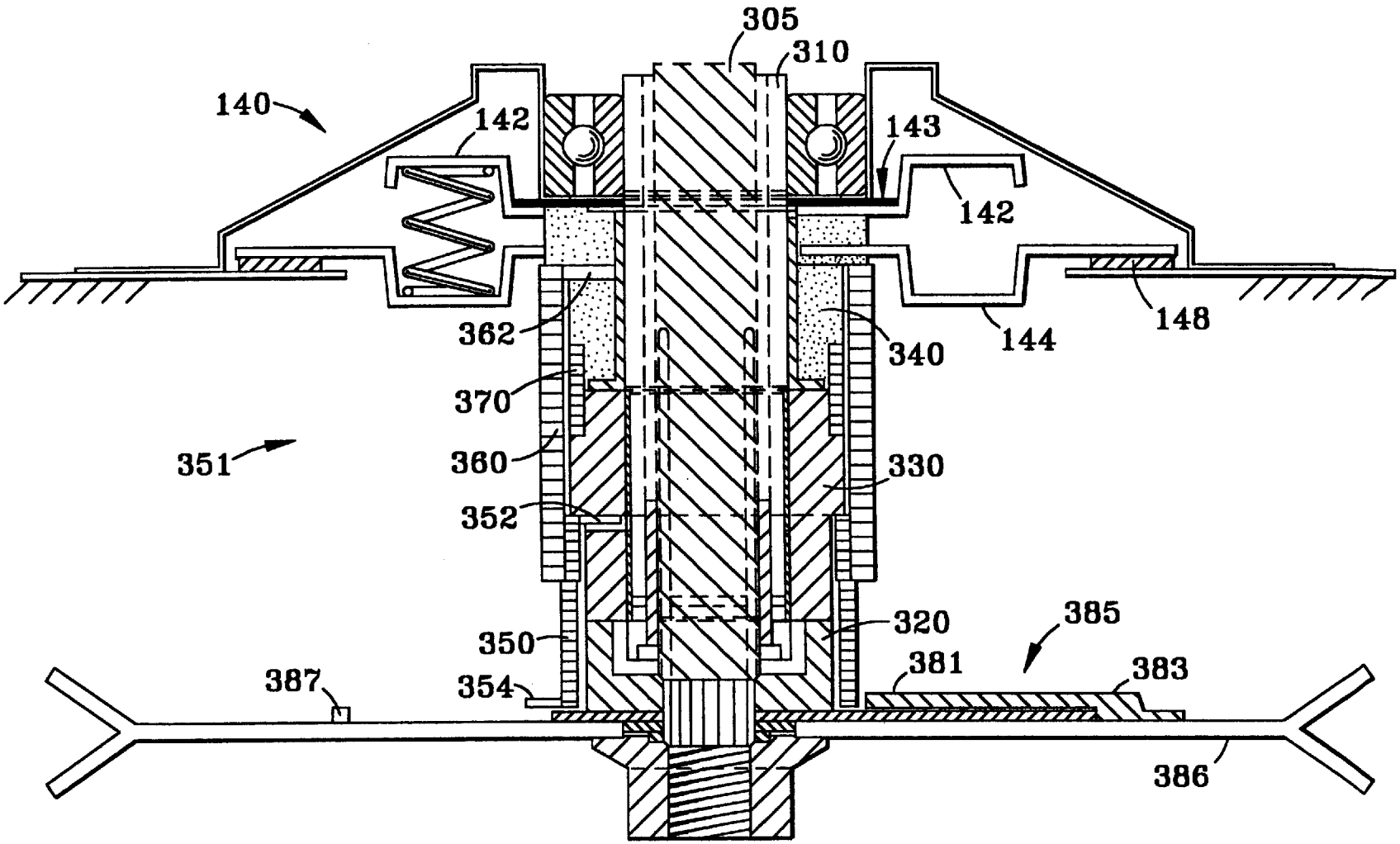
FIG. 9 is an expanded view of the mode shifter of FIG. 5.

In agitation mode, the motor torque is applied to the agitator collar 320 in an oscillatory manner by periodically reversing the variable speed motor 380. The agitator collar 320 rotates alternately in both directions within the basket engagement spring 350 at a rate and stroke controlled by the MCU 388. Typically, the agitation stroke is 360 degrees or less. The outer diameter of the agitator collar 320 is cylindrical along its entire length such that a clearance is established between the agitator collar 320 and the basket engagement spring 350. The clearance allows the agitator collar to rotate alternately in both directions during agitation mode without engaging the basket engagement spring 350. The clearances and interference fits between the springs and collars of the mode shifter of FIG. 5 are shown exaggerated for clarity in FIG. 9.

The basket engagement spring 350 has a clearance of about 0.01 inch with the basket collar 330 in the region of the brake engagement spring 360 and a clearance of about 0.02 inch with the basket collar 330 below the brake engagement spring 360. The basket engagement spring 350 has an interference fit of about 0.01 inch with the brake engagement spring 360 at rest and in agitation mode, where the basket engagement spring 350 is not locked around the basket collar 330 and agitator collar 320. The brake engagement spring 360 has a clearance of about 0.01 inch at rest with the basket collar 330, the basket immobilizer spring 370, and the brake collar 340. The basket immobilizer spring 370 has an interference fit of about 0.01 inch with the brake collar 340 and the basket collar 330.

The transition from agitation mode to spin mode is achieved by continuously turning the motor 380 in a predetermined direction (e.g., the spin direction, counterclockwise viewed from above) for a maximum of 720 degrees, according to one embodiment of the invention shown in FIG. 5. The initiation of spin mode is effected by engaging a spring engagement member 354 which extends radially outwardly from the bottom of the basket engagement spring 350.

To initiate spin mode, the motor 380 rotates the drive pulley 386 in the spin direction. Projecting from the drive pulley 386 is a pulley engagement member 387 which, after a maximum of 360 degrees rotation of the drive pulley 386, engages with a mode shift actuator 385. The mode shift actuator 385, according to one embodiment, is a rigid member which is mounted to and extends radially outwardly from the agitator drive shaft 320 and which is free to rotate independently relative to the other components of the mode shifter 351. The mode shift actuator 385 includes a first portion 383 which is engaged by the pulley engagement member 387, and an inwardly extending arm 381, the inner end of which engages the spring engagement member 354.

In operation, the drive pulley 386 and pulley engagement member 387 rotate a maximum of 360 degrees in one direction until the pulley engagement member 387 hits the first portion 383 of the mode shift actuator 385. As the drive pulley 386 continues to rotate, the pulley engagement member 387 forces the rotation of the mode shift actuator 385. The mode shift actuator 385 rotates a maximum of 360 degrees before its inwardly extending arm 381 engages and rotates the spring engagement member 354 of the basket engagement spring 350. The combination of the pulley engagement member 387 which may rotate 360 degrees before engaging the mode shift actuator 385, and the mode shift actuator 385, which may rotate another 360 degrees before actuating the spring engaging member 354, provides 720 degrees of rotation prior to activation of spin. Those skilled in the art will appreciate that the mode shift actuator and other associated components can be adapted to accommodate any desired angular ranges for initiation of spin mode.

When the spring engagement member 354 is rotated in the spin direction by the arm 381, while the tang 352 remains stationary, the basket engagement spring 350 tightens around the agitator collar 320 and the basket collar 330, locking them together for spin mode. The friction between the agitator collar 320 and the basket engagement spring 350 keeps them locked together during spin mode. The interference fit between the basket engagement spring 350 and the brake engagement spring 360 is lost, since the outer diameter of the basket engagement spring 350 is diminished.

In the opposite rotation direction, the mode shift actuator 385 ratchets past the spring engagement member 354, and the basket engagement spring 350 does not tighten and lock. The inwardly extending arm 381 may be formed to be flexible enough, for example, to snap past the spring engagement member 354 when rotated opposite the spin direction.

To prevent the mode shift actuator 385 from engaging the spring engagement member 354 and initiating spin during the agitation mode, the agitator collar 320 is typically centered half way within the 720 degree range prior to starting the agitation mode. In this way, an agitation stroke of up to 720 degrees can be accommodated without activating spin. Normally, the agitation stroke is much less than 720 degrees, so there is little likelihood that the basket 130 or agitator 120 will wander enough to lead to activation of spin. However, an inadvertent activation of spin mode is harmless, since it will merely cause a rotation of the basket 130 in response to the overshoot of the agitation stroke such that the basket 130 is not rotated in the subsequent agitation stroke.

As long as the agitator collar 320 is supplied with a small spin torque, the basket engagement spring 350 remains locked around the agitator collar 320 and basket collar 330. If during spin mode, the spin torque applied to the agitator collar is interrupted, the basket engagement spring 350 will unwind, releasing the basket collar 330 and the agitator collar 320. At the same time, the outer diameter of the basket engagement spring 350 increases, so that it comes into contact with the inner surface of the brake engagement spring 360. The basket engagement spring 350 continues to spin, because it is rotationally fixed with a tang 352 to the basket collar 330, which continues to spin from the rotational inertia of the basket 130. The rotational inertia of the basket 130 thus produces a torque which is applied to the bottom of the brake engagement spring 360 by friction with the expanded, rotating basket engagement spring 350.

The friction that develops between the basket engagement spring 350 and the brake engagement spring 360 begins to wind the brake engagement spring 360 more tightly around the basket collar 330 and the brake collar 340. The top of the brake engagement spring 360 includes a tang 362 which resides in the brake collar 340 to rotationally fix the brake engagement spring 360 to the brake collar 340. The tang 362 holds the top of the brake engagement spring stationary while the bottom of the brake engagement spring 360 is tightened by the expanded, rotating basket engagement spring 350. The friction between the basket engagement spring 350 and the brake engagement spring 360 winds the brake engagement spring 360 more tightly around the basket collar 330 and the brake collar 340, creating a positive feedback effect which locks the basket collar 330 and brake collar 340 together. When the brake engagement spring 360 locks the basket collar 330 to the brake collar 340, the rotational inertia of the basket 130 causes the upper and lower disks 142, 144 of the brake 142 begin to spin. Energy from the spinning basket is therefore dumped into the braking system, and the basket 130 quickly stops.

If the motor power (spin torque) is restored to the agitator collar 320 before the basket stops, or at any other time, the engagement of the spring engagement member 354 by the arm 381 causes the basket engagement spring 350 to tighten and withdraw inwardly from the brake engagement spring 360. Consequently, the brake engagement spring 360 loosens and unwinds, releasing the lock between the brake collar 340 and the basket collar 330, so that the basket 130 is free to rotate in spin mode without engaging the brake 140. At the same time, the torque on the agitator collar 320 in the spin direction and engagement of the spring engagement member 354 causes the basket engagement spring 350 to tighten and lock around the agitator collar 320 and basket collar 330, thus restoring the spin mode configuration in which the agitator 120 and basket 130 are locked together.

As in the embodiment shown in FIG. 2, a basket immobilizer spring 370 may be provided which works in conjunction with the brake engagement spring 360 to prevent the basket 130 from rotating in either direction during agitation mode. The basket immobilizer spring 370 does not interfere with the spin mode or the braking mode, because the basket immobilizer spring 370 unlocks to permit slippage when the basket collar 330 rotates in the spin direction, freeing the basket collar 330 from the brake collar 340. During braking, the brake engagement spring 360 squeezes down onto the basket immobilizer spring 370 which transmits the radially inward forces of the brake engagement spring 360 to the basket collar 330 and the brake collar 340, which contributes to braking.

During the spin mode, there are typically sufficient mechanical losses to maintain the wound down condition of the basket engagement spring 350, i.e., the mechanical losses are sufficiently large to require a spin torque large enough to maintain the locked condition of the basket engagement spring 350. If the spin torque is reduced below the minimum torque needed to maintain the spin terminal velocity (e.g., 100 to 1,000 rpm), but the spin torque is sufficient to maintain the basket engagement spring 350 in the wound down condition, the basket speed will coast down to a stop without braking. If this is done between the wash and rinse cycles, the rinse liquid can be turned on to fill the basket for the rinse cycle, and the basket will come to a stop faster than it otherwise would, due to the energy associated with accelerating the rinse liquid to the velocity of the basket. Exemplary embodiments of the invention thus allow the basket to be decelerated quickly without actuating the brake, due to the flexibility of a variable speed motor combined with the present mode shifter, which advantageously reduces wear on the brake and reduces noise. Other advantages of exemplary embodiments of the invention are that the brake mode can be activated at any time in the spin cycle, such as when an out-of-balance load is detected by a sensor and severe wear to the machine may result. The brake can also be activated to shorten overall time between cycles. For example, the brake is typically automatically activated after a spin cycle because the motor power is ended, thus shortening the overall wash cycle.

Figure 6:
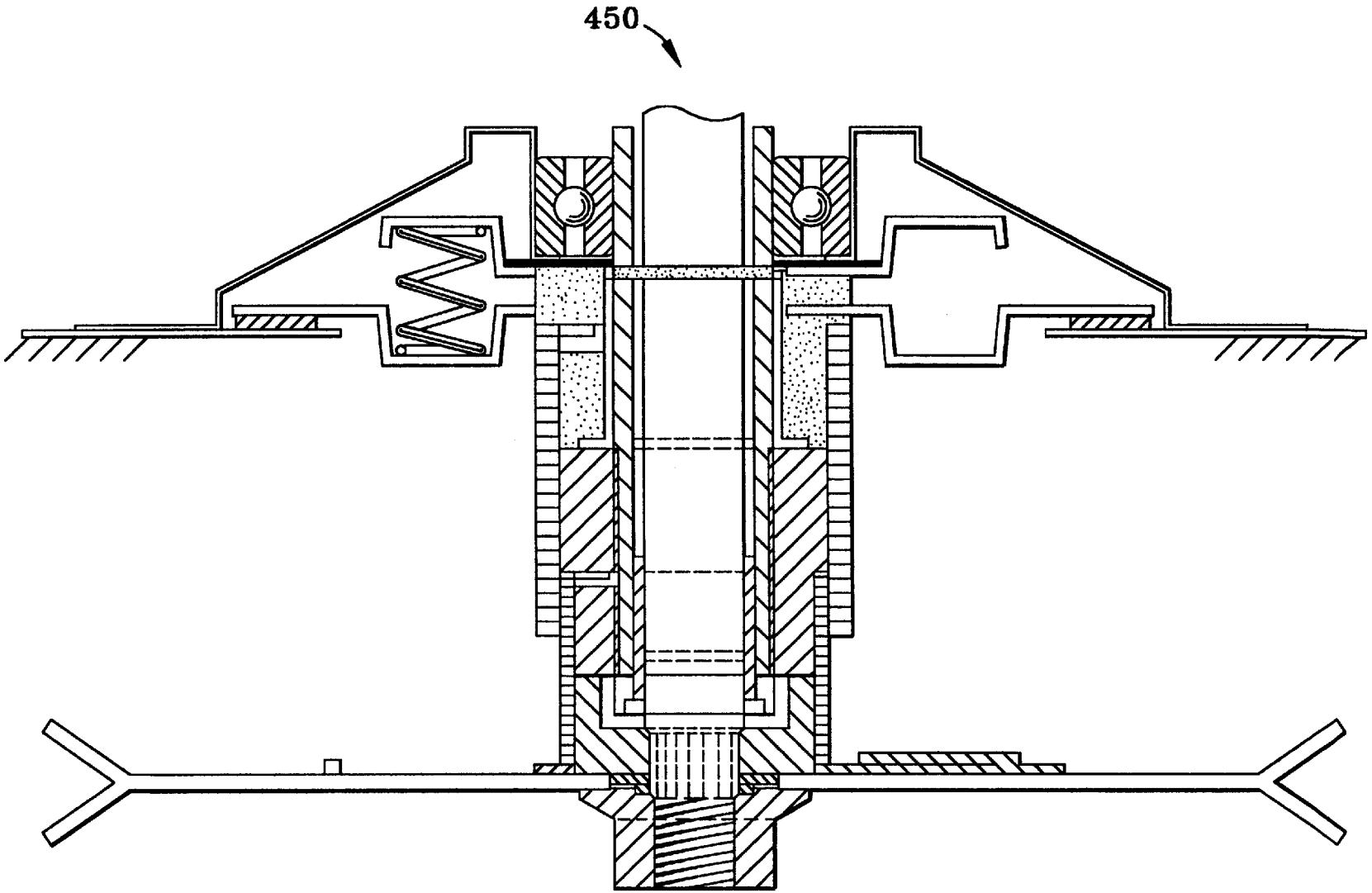
FIG. 6 is a mode shifter according to another embodiment of the invention.

FIG. 6 illustrates a mode shifter 450 according to another embodiment of the invention. The mode shifter 450 operates in a manner similar to the mode shifter 351 shown in FIG. 5. However, the mode shifter 450 of FIG. 6 does not include a basket immobilizer spring (element 370 in FIG. 5). Although the basket immobilizer spring prevents rotation of the basket 130 during agitation mode due to reaction torques from the clothes and wash liquid, the basket immobilizer spring can be omitted, if desired.

Figure 7:
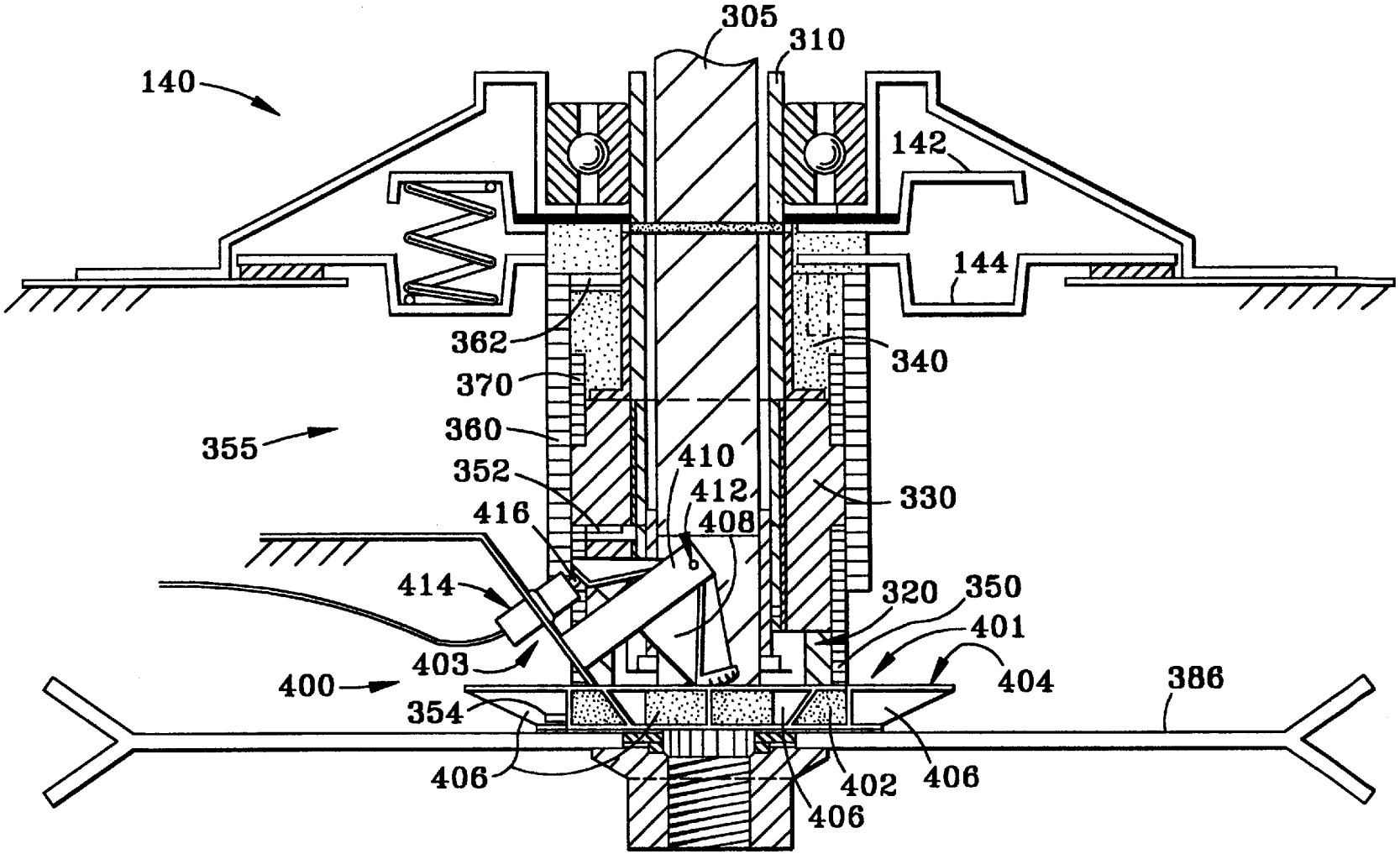
FIG. 7 is an electromechanically activated mode shifter according to another embodiment of the invention.

FIG. 7 illustrates a mode shifter according to another embodiment of the invention which includes an electromechanical actuator. The mode shifter of FIG. 7 operates in substantially the same manner as the mode shifter of FIG. 5, with certain exceptions which will now be described. In FIG. 7, the mode shifter 355 includes an actuator 400 which actuates the mode shifter. The actuator 400 includes an engaging portion 401 and a driving portion 403. The engaging portion 401 includes a cylindrical member 402 which surrounds the basket engagement spring 350 and a disc 404 which extends radially outwardly from the top of the cylindrical member 402. The disc 404 may be supported by ribs 406 which are fixed between the disc 404 and the cylindrical member 402.

The cylindrical member 402 includes a small hole which receives the spring engagement member 354 of the basket engagement spring 350. Thus, rotation of the cylindrical member 402 rotates the spring engagement member 354, which rotates the bottom of the basket engagement spring 350. The disc 404 has a top surface which is used to rotate the cylindrical member 402.

The driving portion 403 includes a contacting member 408, a housing 410, and a driver 414. The contacting member 408 is rotatably fixed in the housing 410 about a pivot point 412. The contacting member 408 is rotated about the pivot point 412 with the driver 414. The driver 414 includes therein a material such as wax which expands upon heating to force out a piston 416. The piston 416 contacts the contacting member 408 and rotates it about the pivot point 412. The fluid in the driver 414 may be heated electrically. The contacting member 408 contacts the top surface of the disc 404 to rotate the engaging portion 401. Those skilled in the art will recognize that other well known electronic components, such as a solenoid, can be implemented to electromechanically actuate the spring engagement member 354.

The basket engagement spring 350, at rest, has a slight interference fit with the agitator collar 320 and basket collar 330. The interference fit is removed by actuating the actuator 400. An electric current is transmitted to the driver 414 to heat the wax and force out the piston 416. The piston 416 rotates the contacting member 408 about the pivot point 412. The contacting member 408 contacts the upper surface of the disc 404 to rotate the engaging portion 401 which rotates the spring engagement member 354. The spring engagement member 354 is rotated to unwind the basket engagement spring 350. When the basket engagement spring is unwound by the actuator 400, which occurs during agitation mode, the agitator collar 320 is free to rotate without engaging the basket engagement spring 350 and the basket.

To initiate spin mode, the actuator 400 is deactivated, and the piston 416 withdraws. The contacting member 408 releases the engaging portion 401, and the interference fit between the basket engagement spring 350 and the agitator and basket collars 320 and 330 is restored. Rotation of the agitator collar 320 by the motor thus creates a positive feedback friction effect which locks the basket engagement spring 350 around the agitator collar 320 and the basket collar 330.

Although particular embodiments of the invention have been described in detail for purposes of illustration, those skilled in the art will recognize that various modifications may be made without departing from the spirit and scope of the invention as defined by the following claims.

What is claimed is:

1. A washing machine comprising:

a basket for holding an article to be washed;

a basket collar coupled to the basket;

an agitator disposed within the basket;

an agitator collar coupled to the agitator;

a brake for reducing a rotational velocity of the basket;

a brake collar coupled to the brake;

a first spring disposed around the basket collar and the agitator collar; and a second spring disposed around the first spring, the basket collar, and the brake collar, wherein the second spring is able to contact the first spring.

2. The washing machine of claim 1, wherein the first spring is adapted to clamp the agitator collar to the basket collar.

3. The washing machine of claim 2, wherein the first spring, when clamped to the agitator collar and basket collar, does not engage the second spring.

4. A washing machine comprising:

a basket for holding an article to be washed;

a basket collar coupled to the basket;

an agitator disposed within the basket;

an agitator collar coupled to the agitator;

a brake for reducing a rotational velocity of the basket;

a brake collar coupled to the brake;

a first spring disposed around the basket collar and the agitator collar; and a second spring disposed around the first spring, the basket collar, and the brake collar, wherein the first spring is adapted to release the agitator collar and the basket collar when a spin torque is removed from the agitator collar, and to contact the second spring to cause the second spring to clamp together the brake collar and the basket collar.

5. A washing machine comprising:

a basket for holding an article to be washed;

a basket collar coupled to the basket;

an agitator disposed within the basket;

an agitator collar coupled to the agitator;

a brake for reducing a rotational velocity of the basket;

a brake collar coupled to the brake;

a first spring disposed around the basket collar and the agitator collar; and a second spring disposed around the first spring, the basket collar, and the brake collar, wherein the first spring has an outer diameter at rest which is greater than an inner diameter of the second spring.

6. A washing machine comprising:

a basket for holding an article to be washed;

a basket collar coupled to the basket;

an agitator disposed within the basket;

an agitator collar coupled to the agitator;

a brake for reducing a rotational velocity of the basket;

a brake collar coupled to the brake;

a first spring disposed around the basket collar and the agitator collar; and a second spring disposed around the first spring, the basket collar, and the brake collar, wherein the basket collar has an outer diameter which is less than an inner diameter of the first spring at rest.

7. A washing machine comprising:

a basket for holding an article to be washed;

a basket collar coupled to the basket;

an agitator disposed within the basket;

an agitator collar coupled to the agitator;

a brake for reducing a rotational velocity of the basket;

a brake collar coupled to the brake;

a first spring disposed around the basket collar and the agitator collar; and a second spring disposed around the first spring, the basket collar, and the brake collar, wherein the brake collar and the basket collar each have an annular recess formed in a peripheral portion thereof, and the washing machine further comprises a third spring disposed in the annular recess of the brake collar and the basket collar.

8. The washing machine of claim 7, wherein the first and second springs are wound in a first direction, and the third spring is wound in a second direction which is opposite the first direction.

9. The washing machine of claim 7, wherein the third spring is adapted to clamp the brake collar to the basket collar when the basket collar is rotated in one direction.

10. The washing machine of claim 1, further comprising an AC induction motor coupled to the agitator collar.

11. A washing machine comprising:

a basket for holding an article to be washed;

a basket collar coupled to the basket;

an agitator disposed within the basket;

an agitator collar coupled to the agitator;

a brake for reducing a rotational velocity of the basket;

a brake collar coupled to the brake;

a first spring disposed around the basket collar and the agitator collar; and a second spring disposed around the first spring, the basket collar, and the brake collar, further comprising a transmission, connected between the agitator collar and the agitator, for transforming a continuous rotation of the agitator collar into an oscillatory motion of the agitator.

12. The washing machine of claim 1, wherein the agitator collar comprises:

a first portion having an interference fit with the first spring; and a second portion having a clearance with the first spring.

13. The washing machine of claim 1, wherein rotation of the agitator in a first direction causes the first spring to clamp together the agitator collar and the basket collar.

14. The washing machine of claim 1, further comprising a variable speed motor coupled to the agitator collar.

15. The washing machine of claim 1, further comprising a single-phase electronically commutated motor coupled to the agitator collar.

16. The washing machine of claim 1, wherein the first spring comprises an engagement member, and the washing machine further comprises:

means for engaging the engagement member after the agitator collar has rotated less than or equal to a predetermined number of degrees in one direction.

17. The washing machine of claim 16, wherein the means for engaging engages the engaging member of the agitator collar after the agitator collar has rotated less than or equal to 720 degrees.

18. The washing machine of claim 1, wherein the agitator collar has an outer diameter which is less than an inner diameter of the first spring.

19. The washing machine of claim 1, further comprising an electromechanical actuator which unwinds the first spring such that the agitator collar moves freely within the first spring.

20. The washing machine of claim 19, wherein the electromechanical actuator rotates a spring engagement member of the first spring in response to an electrical signal.

21. A method of operating a washing machine comprising the steps of:

moving an agitator collar freely within a first spring to power an agitator;

clamping the first spring onto the agitator collar and a basket collar connected to a basket;

applying a torque to the agitator collar to spin the basket; and releasing the torque on the agitator collar such that:

the first spring releases from clamping the agitator collar to the basket collar; and the first spring expands to contact a second spring causing the second spring to clamp together the basket collar and a brake collar connected to a brake.

22. The method of claim 21, wherein the step of moving the agitator collar freely comprises oscillating the agitator collar.

23. The method of claim 21, wherein the step of moving the agitator collar freely comprises rotating the agitator collar in one direction.

24. The method of claim 21, wherein the step of clamping the first spring comprises reversing a direction of rotation of the agitator collar to cause the first spring to clamp by friction with the agitator collar.

25. The method of claim 21, wherein the step of clamping the first spring comprises rotating a first engaging member with the agitator collar such that the first engaging member contacts a second engaging member on the first spring to cause the first spring to clamp.

26. The method of claim 21, further comprising the step of clamping the brake collar to the basket collar with a third spring when the basket is rotated in a first direction.

27. A mode shifter comprising:

a basket collar coupled to a basket;

an agitator collar coupled to an agitator;

a brake collar coupled to a brake;

a first spring disposed around the basket collar and the agitator collar; and a second spring disposed around the first spring, the basket collar, and the brake collar, wherein the second spring is able to contact the first spring.

28. The mode shifter of claim 27, wherein the first spring is adapted to clamp the agitator collar to the basket collar.

29. The mode shifter of claim 28, wherein the first spring, when clamped to the agitator collar and basket collar, does not engage the second spring.

30. A mode shifter comprising:

a basket collar coupled to a basket;

an agitator collar coupled to an agitator;

a brake collar coupled to a brake;

a first spring disposed around the basket collar and the agitator collar; and a second spring disposed around the first spring, the basket collar, and the brake collar, wherein the first spring is adapted to release the agitator collar and the basket collar when a spin torque is removed from the agitator collar, and to contact the second spring to cause the second spring to clamp together the brake collar and the basket collar.

31. A mode shifter comprising:

a basket collar coupled to a basket;

an agitator collar coupled to an agitator;

a brake collar coupled to a brake;

a first spring disposed around the basket collar and the agitator collar; and a second spring disposed around the first spring, the basket collar, and the brake collar, wherein the brake collar and the basket collar each have an annular recess formed in a peripheral portion thereof, and the washing machine further comprises a third spring disposed in the annular recess of the brake collar and the basket collar.

32. The washing machine of claim 31, wherein the first and second springs are wound in a first direction, and the third spring is wound in a second direction which is opposite the first direction.

33. The mode shifter of claim 27, wherein rotation of the agitator in a first direction causes the first spring to clamp together the agitator collar and the basket collar.

34. The mode shifter of claim 27, wherein the first spring comprises an engagement member, and the washing machine further comprises:

means for engaging the engagement member after the agitator collar has rotated less than or equal to a predetermined number of degrees in one direction.

35. The mode shifter of claim 27, further comprising an electromechanical actuator which unwinds the first spring in response to receiving an electrical signal.

36. A washing machine comprising:

a basket for holding articles to be washed;

an agitator disposed in the basket for agitating the articles;

a brake for reducing a rotational velocity of the basket; and a spring which rotationally fixes the agitator to the basket, and which activates the brake as a result of a reduction in a spin torque applied to the agitator.

37. A washing machine comprising:

a basket for holding articles to be washed;

an agitator disposed in the basket for agitating the articles;

a brake for reducing a rotational velocity of the basket; and a spring which rotationally fixes the agitator to the basket, and which activates the brake, further comprising a second spring, wherein the spring activates the brake by causing the second spring to rotationally fix the basket to the brake.

* * * * *